US006004119A

United States Patent [19]

Hamasaki et al.

[11] Patent Number: 6,004,119

[45] Date of Patent: Dec. 21, 1999

[54] MOTOR-DRIVEN HYDRAULIC GEAR PUMP HAVING A NOISE DAMPER

[75] Inventors: Yoshiaki Hamasaki, Kashiba; Yoshifumi Obata, Sakurai; Toshio Iida, Kashiwara, all of Japan

[73] Assignee: Koyo Seiko Co., Ltd., Osaka, Japan

[21] Appl. No.: 08/889,030

[22] Filed: Jul. 7, 1997

[30] Foreign Application Priority Data

Jul. 17, 1996 [JP] Japan ..... 8-187858
Jun. 18, 1997 [JP] Japan ..... 9-161623

[51] Int. Cl.[6] ..... F04C 2/18; F04C 15/00; F04B 11/00

[52] U.S. Cl. ..... 418/181; 418/206.1; 417/540

[58] Field of Search ..... 418/181, 206.1; 417/312, 540

[56] References Cited

U.S. PATENT DOCUMENTS

| | | | |
|---|---|---|---|
| 1,972,271 | 9/1934 | McIntyre | 418/79 |
| 2,912,937 | 11/1959 | Insley | 417/540 |
| 4,207,033 | 6/1980 | Drutchas et al. | 417/540 |
| 5,692,883 | 12/1997 | Vourc'h | 418/181 |

FOREIGN PATENT DOCUMENTS

| | | | |
|---|---|---|---|
| 2372970 | 6/1978 | France . | |
| 2728313 | 6/1996 | France . | |
| 837207 | 4/1952 | Germany | 418/206 |
| 4120757 | 1/1992 | Germany . | |
| 4334228 | 10/1994 | Germany . | |
| 43 32 975 | 5/1995 | Germany . | |
| 3-15592 | 3/1991 | Japan . | |
| 5-58882 | 8/1993 | Japan . | |
| 2014499 | 6/1994 | Russian Federation | 418/181 |
| 2036873 | 7/1980 | United Kingdom | 418/206 |
| 1072426 | 6/1997 | United Kingdom . | |

*Primary Examiner*—John J. Vrablik
*Attorney, Agent, or Firm*—Darby & Darby

[57] ABSTRACT

A motor-driven hydraulic pump for use in motor vehicles and a driving coupler used therein, in which the pump includes a driving gear and a follower gear, an intake chamber and an outlet chamber formed on opposite sides of the meshed gears, a housing for enclosing the intake chamber and the outlet chamber, the housing being supported by a first support on one side and a second support on the other side, and a noise damper including a space inside for reducing noise occurring during the delivery of a working oil, the noise damper communicating with the outlet chamber and being fixed to the second support of the housing, and wherein the driving coupler includes a protruding, undulated sleeve including a mortise mating with a tenon formed on the end of either the driving shaft or the driven shaft, and a sleeve counterpart including a mortise mating with a tenon formed on the end of the other shaft, and a protruding, splined projection which includes splines shaped to fit into the undulated sleeve, with spaces between the undulated sleeve and the splines being filled with an elastic material.

2 Claims, 13 Drawing Sheets

MOTOR-DRIVEN HYDRAULIC GEAR PUMP HAVING A NOISE DAMPER

BACKGROUND OF THE INVENTION

1. Field of the Invention

The present invention relates to a motor-driven hydraulic pump (hereinafter referred to as "motor-driven pump") and a driving coupler used therein to transmit a driving force from an input shaft to an output shaft, wherein the pump generates hydraulic pressure for operating hydraulic assist devices such as a steer-assisting hydraulic cylinder and an automatic transmission.

2. Description of Related Art

Motor vehicles, especially road vehicles, are commonly equipped with hydraulic assist devices such as a steer-assisting hydraulic cylinder and an automatic transmission so as to maintain an optimum engine speed and a comfortable road running. These hydraulic assist devices are operated by pumps such as vane pumps and gear pumps, which are driven by the engine of the vehicle. In operating the steer-assisting hydraulic cylinder, the pump is operated at varying speeds by reference to the road speeds of the vehicle. For example, it will be operated at high speed when the vehicle runs at low speed or is brought to a stop where a large steer-assisting force is required, and it will be operated at low speed when the vehicle runs at high speed where little steer-assisting force is required. However, the engine of the vehicle is difficult to cope with such frequent changes in the operating speeds of the pump. In order to meet these demands, an extra electric motor whose outputs are readily adjusted is used for the hydraulic pump independently of the engine of the vehicle. This solution is proposed and disclosed in Japanese Patent Publication (allowed) No. 3-15592. It will be briefly described with reference to FIG. 12:

The illustrated motor-driven pump is provided with an electric motor (M) and a pump housing (B) including a support portion (C) which is provided with an oil outlet path (E) through which a working oil is forced out. The electric motor (M) includes a motor shaft (input shaft) (m). The pump housing (B) includes a pump shaft (output shaft) (a) coupled to the motor shaft (m), and also houses a intake chamber (not shown) in which a driving gear (A) driven by the motor shaft (m) and a follower gear (not shown) are mutually in mesh, and deliver a working oil to an outlet chamber (not shown) communicating with the oil outlet path (E).

In recent years, electric vehicles (EV) are developed so as to avoid environmental contamination due to exhaust gases. Electric vehicles are driven by an electric motor instead of an oil engine. They are also equipped with a steer-assisting hydraulic devices operated by a motor-driven pump.

In either case where an electric motor is used to operate the pump, the problem is the limited accommodation space in the vehicle. To solve this problem, the pump and the electric motor are compactly combined or unified as shown in the Japanese Publication No. 3-15592 referred to above where a conventional mortise-tenon connection is used to couple the motor shaft and the pump shaft as shown in FIG. 13.

Referring to FIG. 13, an input shaft (motor shaft) (m) and an output shaft (pump shaft) (a) are coupled to each other by means of a driving coupler (hereinafter referred to as "coupler") (J). The coupler (J) includes a first mortise J1 and a second mortise J2 on opposite ends. The input shaft (m) includes a tenon m1, and the output shaft 4 includes a tenon al. The tenons m1 and al are inserted in the mortises J1 and J2, respectively, thereby coupling the motor shaft (m) to the pump shaft (a) such that a torque is transmitted through this mortise-tenon connection. As shown in FIG. 13, the rectangular mortises J1 and J2 are formed like a cross such that a torque is effectively transmitted from the motor shaft (m) to the pump shaft (a) through the coupler (J).

The mortise-tenon connection advantageously ensures the coaxial alignment of the input shaft (m) and output shaft (a). An alternative embodiment is disclosed in Japanese Utility Model Laid-Open Specification No. 5-58882, the disclosure of which is herein incorporated by reference; briefly, the tenons ml and al are provided in the coupler J, and the mortises J1 and J2 are provided in the motor shaft (m) and the pump shaft (a).

The known motor-driven pump described above has an oil reservoir defined by a space between the teeth of the driving gears (A) and the follower gears and the inside wall of the pump housing (B). The oil is intermittently delivered every time each oil reservoir is opened to the outlet chamber in the pump housing (B). The problem of this system is the pulsation occurring in the flow of oil which causes the driven shaft (pump shaft) (a) to vibrate.

The coupler (J) is normally made of metal but a metal coupler is likely to cause noise in transmitting a torque from the input shaft (m) to the output shaft (a). Sometimes the noise is so harsh that the driver misunderstands that anything is wrong with his or her car.

Researches have found out that the noise is caused by the pump shaft (a) vibrating in accordance with pulsation occurring in the oil flow within the pump housing (B), and rattling against the coupler (J). To avoid this noise problem plastics-made couplers are proposed instead of metal-made couplers. A plastics-made coupler (J) can effectively absorb vibration but is too fragile to transmit a large torque and is liable to fracture under a large load. To withstand large loads, the plastics-made coupler requires a large size of sufficient thickness. Such large and thick couplers may present other disadvantages.

BRIEF SUMMARY OF THE INVENTION

The present invention has been made to solve the problems pointed out above, and it is an object to provide a motor-driven pump which delivers a working oil from an intake chamber through an outlet chamber with no harsh noise.

Another object of the present invention is to provide a driving coupler which can steadily transmit a torque, large or small, without harsh noise.

According to a first aspect of the present invention a motor-driven hydraulic pump for use in motor vehicles includes a driving gear and a follower gear, an intake chamber and an outlet chamber formed on opposite sides of the meshed gears, a housing for enclosing the intake chamber and the outlet chamber, the housing being supported by a first support on one side and a second support on the other side, and a noise damper including a space inside for reducing noise occurring during the delivery of a working oil, the noise damper communicating with the outlet chamber and being fixed to the second support of the housing.

According to a second aspect of the present invention, a driving coupler includes a protruding, undulated sleeve including a mortise mating with a tenon formed on the end of either the driving shaft or the driven shaft, and a sleeve counterpart including a mortise mating with a tenon formed on the end of the other shaft, and a protruding, splined projection which includes splines shaped to fit into the undulated sleeve, with spaces between the undulated sleeve and the splines being filled with an elastic material.

The above and further objects and features of the present invention will be more fully apparent from the following detailed description with the accompanying drawings.

BRIEF DESCRIPTION OF THE SEVERAL VIEWS OF THE DRAWING

The present invention will now be described by way of example with reference to the drawings, in which.

DETAILED DESCRIPTION OF THE INVENTION

Figure 1:
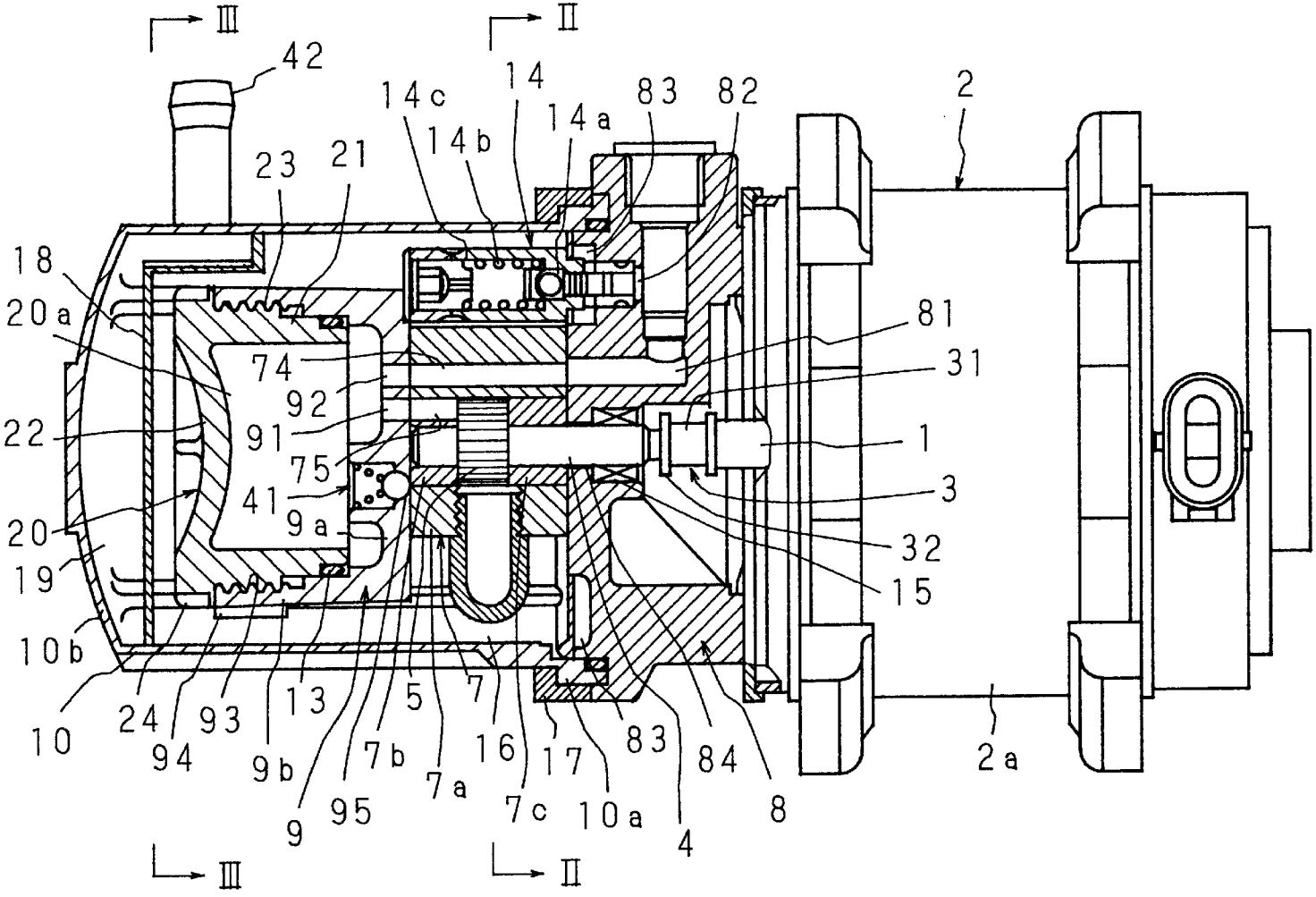
FIG. 1 is a partially cross-sectional side view showing a motor-driven pump according to the present invention.
Figure 2:
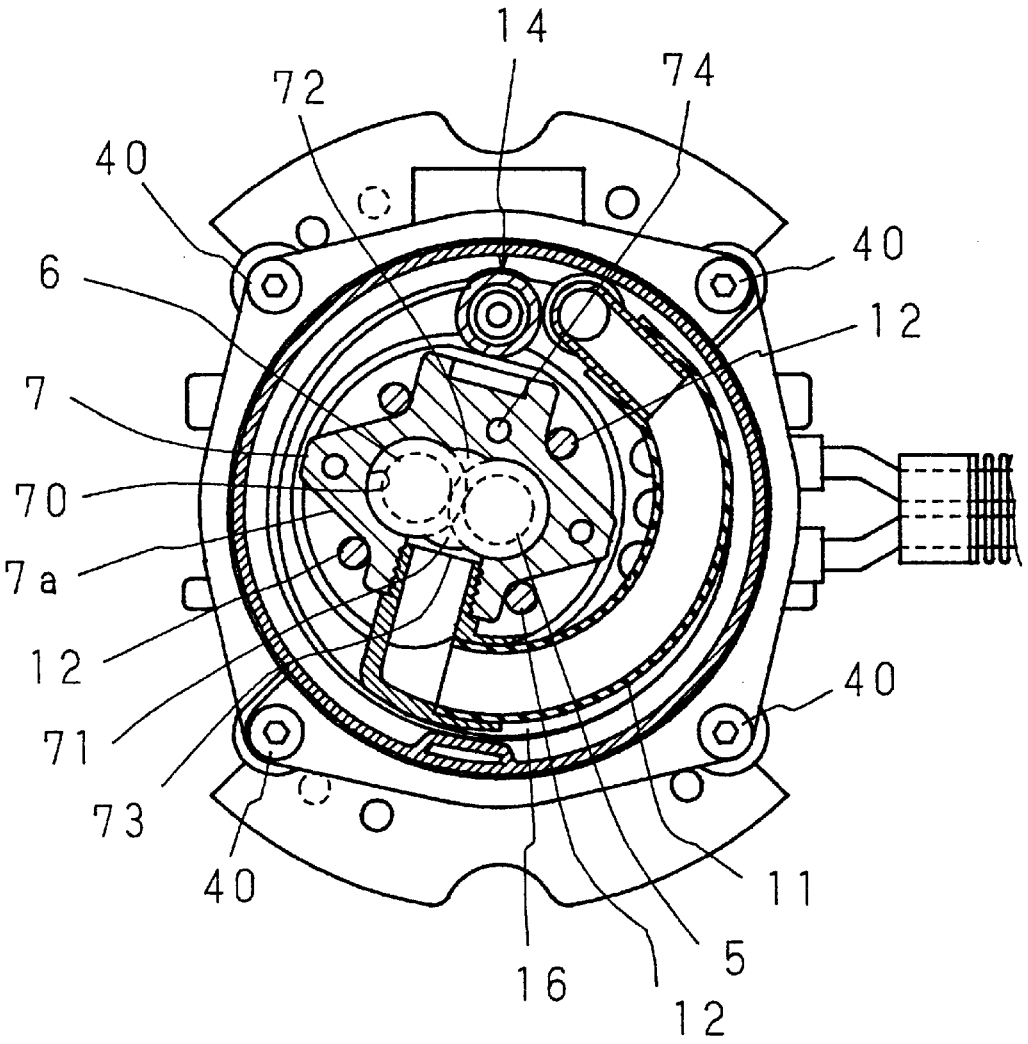
FIG. 2 is a cross-section taken along the II—II line in FIG. 1.
Figure 3:
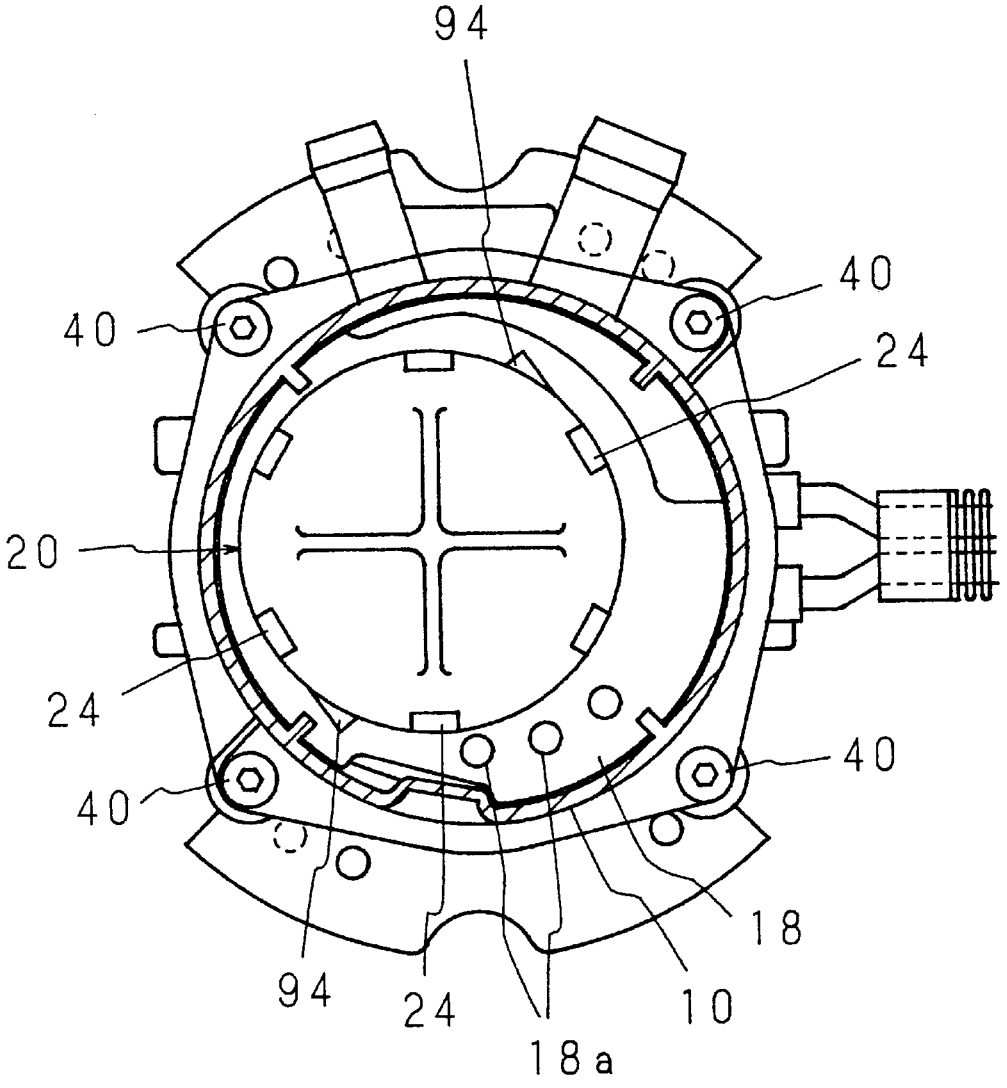
FIG. 3 is a cross-section taken along the III—III line in FIG. 1.
Figure 4:
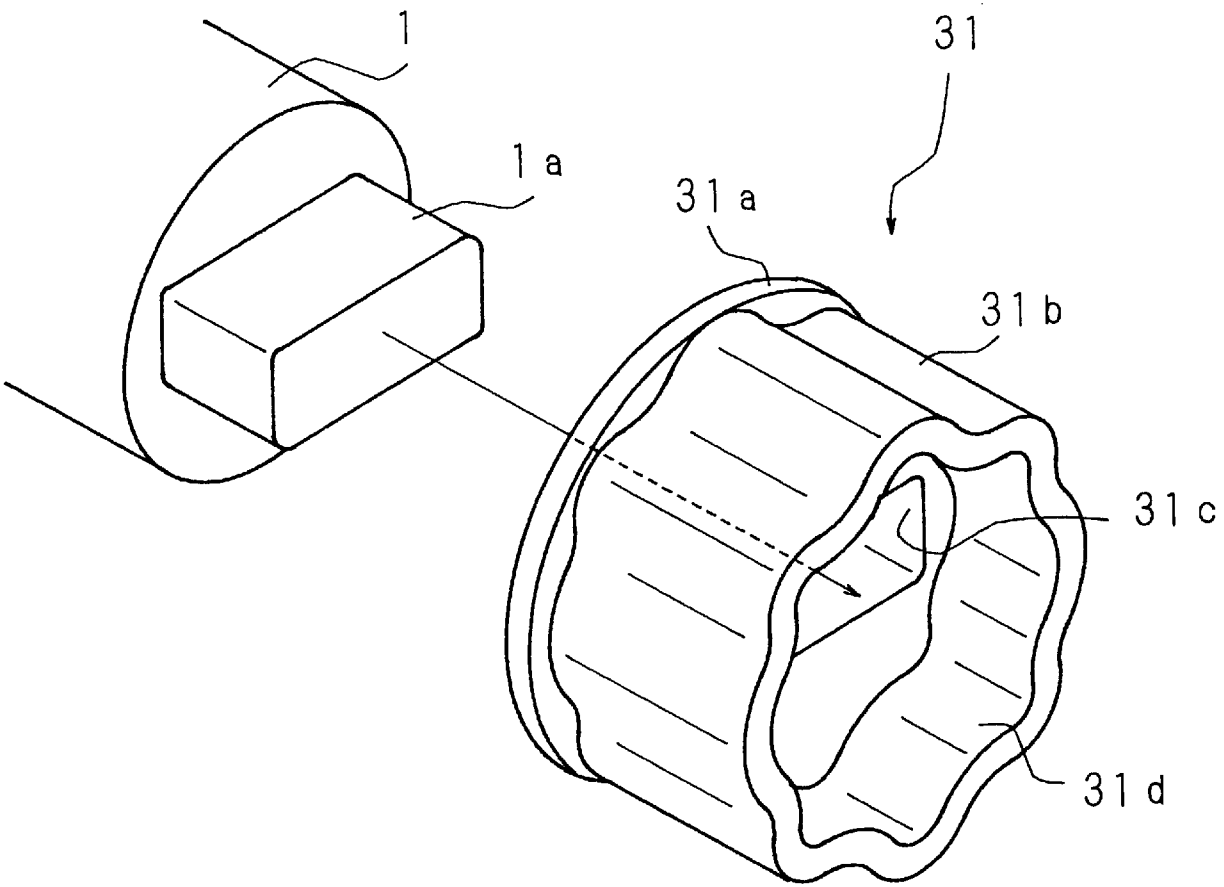
FIG. 4 is a perspective view showing a protruding, undulated sleeve.
Figure 5:
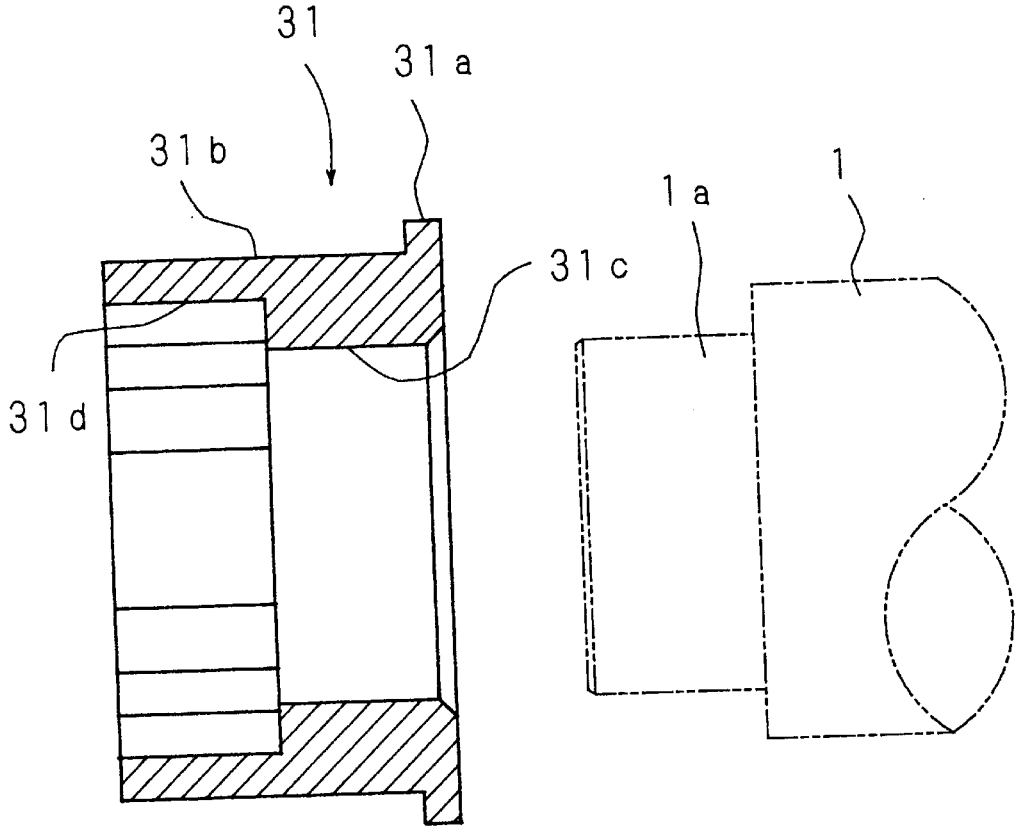
FIG. 5 is a vertical cross-section through the sleeve shown in FIG. 4.

Embodiments of the present invention will now be described by way of example with reference to the drawings:

Referring to FIGS. 1 to 3, the exemplary motor-driven pump is provided with an electric motor 2 having a motor shaft (input shaft) 1 and a pump shaft (output shaft) 4 coupled together by means of a driving coupler 3, and a pump housing 7 enclosing a driving gear 5 driven by the motor 2 and a follower gear 6 engageable with the driving gear 5, the pump housing 7 being firmly held by a first support 8 on one side and a second support 9 on the other side, and a cylindrical tank housing 10 mantling the pump housing 7 and the second support 9. The driving gear 5 and the follower gear 6 are mutually in mesh, and defines an intake chamber 71 on one side and an outlet chamber 72 on the other side through which the working oil is forced out. More specifically, the pump housing 7 is provided with a cylindrical wall 7*a* defining a gear chamber 70 closed by a pair of side plates 7*b* and 7*c* having bores through which the driven shaft 4 and a follower shaft (not shown) are carried to support the driving gear 5 and the follower gear 6 in a rotative manner. The working oil is introduced into the intake chamber 71 from which it is released into the outlet chamber 72.

The cylindrical wall 7*a* is provided with an intake port 73 which is open to the gear chamber 70, and a first outlet path 74 axially bored on the opposite side thereof. The side plate 7*b* is provided with an outlet port 75 which is open to the outlet chamber 72. The intake port 73 is provided with a packing 11 made of rubber designed to function as a noise absorber for reducing noise possibly occurring when the working oil confined in and around the gears 5 and 6 in mesh is returned into the intake chamber 71.

The first support 8 of the pump housing 7 is detachably fixed to a casing of the motor 2, and the second support 9 is detachably fixed to the first support 8 by means of screws 12 (four screws in the embodiment shown in FIG. 2) arranged on the outer surface of the cylindrical wall 7*a*, thereby ensuring that the pump housing 7 is firmly held.

The second support 9 is provided with a first bore 91 communicating with the outlet port 75, and a second bore 92 held in parallel with the first bore 91. The second support 9 is also provided with a bottom portion 9*a* and a side portion 9*b* having threads 93 near the open end. There is provided a cylindrical noise damper 20 which includes a space 20*a* inside whose capacity is larger than that of the outlet chamber 72.

The cylindrical noise damper 20 is inserted into the second support 9 with a seal 13 placed therebetween, so as to prevent oil leakage. The side portion 9*b* is provided with projections 94 at the diametrically opposite positions whereby any unwanted rotation of the second support 9 is prevented as described below.

The noise damper 20 is provided with threads 23 on its outside surface, the threads 23 being engaged with the threads 93 of the side portion 9*b*. In this way the noise damper 20 and the second support 9 are connected together.

The noise damper 20 is provided with recesses 24 at equal intervals along its bottom 22. When it is fixed to the second support 9, a tool is inserted in the recesses 24, and the damper 20 is rotated with the projections 94 on the second support 9 being held by another tool. The noise damper 20 has an inwardly convex bottom 22 as shown in FIG. 1 whereby a detrimental build-up of high hydraulic pressure on the bottom 22 is avoided. The first support 8 is provided with a second outlet oil path 81 of L-shape communicating with the first outlet oil path 74, a relief oil path 82 which is open to the second outlet oil path 81, a ring-shaped oil return path 83 communicating with the relief oil path 82 through a relief valve 14 fixed thereto, and a bore 84 through which the driven shaft 4 is carried, the bore 84 being kept liquid-tight with a seal 15. The oil return path 83 communicates with a low pressure chamber 16 in the tank housing 10, and allows a working oil to return thereto through the relief valve 14.

The relief valve 14 is a cartridge type which includes a valve body 14*a* closing the relief oil path 82, a spring 14*b* biasing the valve body 14*a*, and a housing 14*c* holding the valve body 14*a* and the spring 14*b*. The relief valve 14 is detachably inserted in the relief oil path 82, and if an excessive pressure exerts on the second outlet oil path 81, it is automatically opened so as to escape the pressure. The valve housing 14*c* is kept in abutment with the bottom portion 9*a* of the second support 9.

As shown in FIG. 2, the tank housing 10 is detachably fixed to the first support 8 by bolts 40 (four bolts in the illustrated embodiment) through a ring-shaped clamp 17.

The tank housing 10 provides an oil reservoir inside to hold a working oil. The oil reservoir is divided into the low pressure chamber 16 and a return chamber 19 by a disc-shaped partition 18, wherein the low pressure chamber 16 defined by the partition 18 and the first support 8 houses the pump housing 7, the second support 9 and the noise damper 20, and the return chamber 19 defined by the partition 18 and the tank housing 10 has a bottom portion 10*b* which provides a sub-reservoir (not shown) from which the working oil therein falls by gravity and flows into the low pressure chamber 16 through oil return bores 18*a* until the low pressure chamber 16 becomes full.

The oil return bores 18*a* are produced in place through the partition 18, thereby enabling the oil in the return chamber 19 to return to the low pressure chamber 16 after the pressure is reduced.

The bottom portion 9*a* of the second support 9 communicates with the outlet chamber 72 through a bore 95 in which a spring-biased check valve 41 is provided. Part of the working oil in the oil path toward the high pressure side is caused to return into the inside space 20*a* of the noise damper 20 through the check valve 41 if the electric motor 2 stops because of any malfunction occurring in supplying a working oil.

The driven shaft 4 (pump shaft) carrying the driving gear 5 is protruded through the bore 84 toward the electric motor 2, and is coaxially kept in abutment with the driving shaft (motor shaft) 1. In this state the motor shaft 3 and the pump shaft 4 are coupled together by means of the driving coupler 3.

Now, the driving coupler according to the present invention will be described with reference to FIGS. 1, and 4 to 7:

The exemplary driving coupler 3 includes a sleeve 31 and a sleeve counterpart 32. The sleeve 31 is connected to the motor shaft 1 and the sleeve counterpart 32 is connected to the pump shaft 4 such that these two shafts 1 and 4 are coaxially aligned. The motor shaft 1 and the pump shaft 4 are respectively provided with tenons 1*a* and 4*a* on one end, both tenons 1*a* and 4*a* being rectangular in cross section. The sleeve 31 protrudes on a disc-shaped flange 31*a* toward the motor shaft 1 and has an undulated side wall 31*b* in which a mortise 31*c* mating with the tenon 1*a* is formed. The sleeve 31 is engaged with the motor shaft 1 by pushing the tenon 1*a* into the mortise 31*c* or vice versa. The undulated side wall 31*b* of the sleeve 31 is optionally shaped like six-petals in cross section. The undulated side wall 31*b* defines a recess 31*d* inside formed coaxial with the mortise 31*c*. The recess 31*d* is adapted for reception of the sleeve counterpart 32 as described below.

Figure 6:
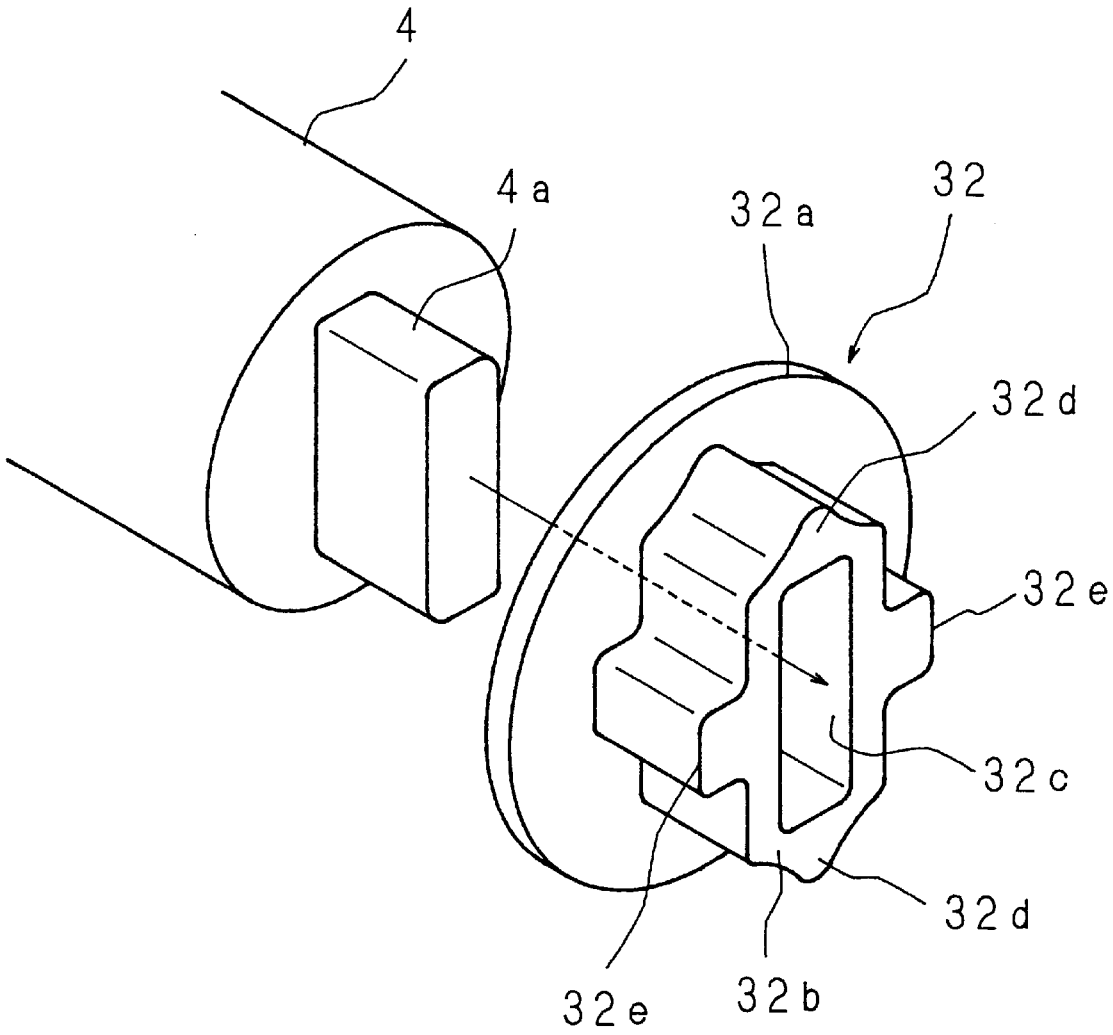
FIG. 6 is a perspective view showing a sleeve counterpart mating with the sleeve shown in FIG. 4, especially showing a protruding, splined projection.
Figure 7:
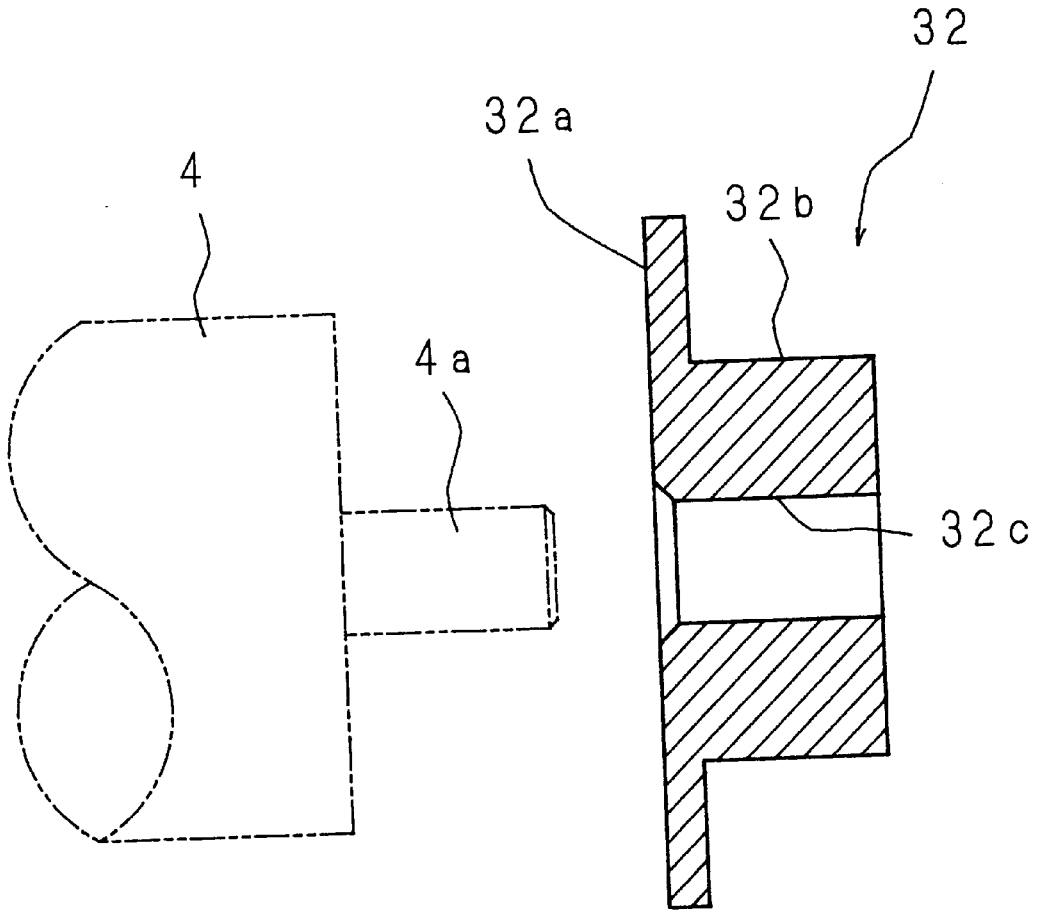
FIG. 7 is a vertical cross-section through the sleeve counterpart shown in FIG. 6.

As shown in FIGS. 6 and 7, the sleeve counterpart 32 includes a disc-shaped flange 32*a* toward the pump shaft 4 and a protruding, splined projection 32*b* on the other end which includes a mortise 32*c* inside mating with the tenon 4*a*, and splines 32*d* and 32*e* along the periphery. The splines 32*d* include a top spline and a bottom spline on diametrically opposite sides, being triangular in cross section. The splines 32*e* extend sideways, being rectangular in cross section. Hereinafter, the splines 32*d* and 32*e* will be referred to as "top and bottom splines 32*d*" and "side splines 32*e*", respectively.

The pump shaft 4 is connected to the sleeve counterpart 32 by fitting the tenon 4*a* thereof into the mortise 32*c* as indicated by the arrow in FIG. 6. Then the sleeve counterpart 32 is joined to the sleeve 31 by inserting the splined projection 32*b* into the recess 31*d* of the sleeve 31. The splines 32*b* and 32*e* are placed in contact with the undulated inside wall of the recess 31*d*.

In this way the driving coupler 3 connects the motor shaft 1 to the pump shaft 4 by a double connection; first, by fitting the tenons 1*a* into the mortise 31*c* of the sleeve 31 and the tenon 4*a* into the mortise 32*c* of the sleeve counterpart 32, and second, by fitting the sleeve counterpart 32 into the sleeve 31. The first step and the second step are vice versa.

Figure 8:
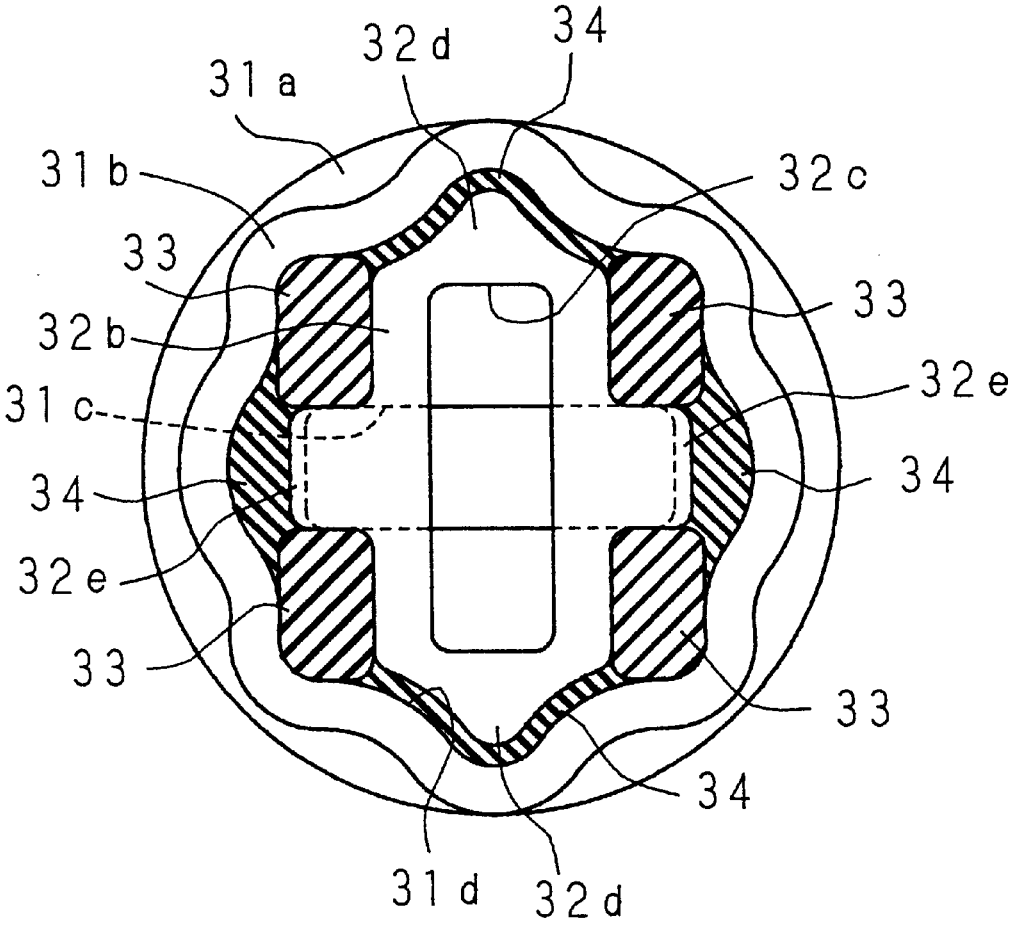
FIG. 8 is a horizontal cross-section showing an assembled sleeve and sleeve counterpart.

As shown in FIG. 8, when the motor shaft 1 and the pump shaft 4 are coupled together, the mortise 31*c* of the sleeve 31 and the mortise 32*c* of the sleeve counterpart 32 face each other in the form of a cross. In this state spaces are formed between the splined projection 32*b* of the sleeve counterpart 32 and the undulated inside wall of the recess 31*d* of the sleeve 31. These spaces are filled with bar-like rubber 33; in the illustrated embodiment four spaces are filled with it, and the layer-like spaces are filled with rubber strips 34, which function as noise absorbers. The vibration reduced by the noise damper 20 is additionally absorbed in the rubber 33 and rubber strips 34 which are liable to elastic deformation.

A major advantage of the driving coupler 3 is that the motor shaft 1 and the pump shaft 4 are readily kept in coaxial alignment, thereby facilitating the connection between the motor shaft 1 and the pump shaft 4.

An example of the manner of coupling the driving shaft 1 to the driven shaft 4 by the coupler 3 will be described:

The first step is to connect the coupler 3 to the motor shaft 1, and then to the pump shaft 4, or vice versa. Then the electric motor 2 is fixed to the first support 8 with the coaxial alignment of the motor shaft 1 and the pump shaft 4 being kept.

Next, the flow of a working oil through the system described above will be described:

The electric motor 2 is driven, and causes the driving shaft 1 to rotate. The torque is transmitted to the driven shaft (pump shaft) 4 which rotates the driving gear 5 and the follower gear 6 together. In accordance with the rotation of the gears 5 and 6 the oil in the low pressure chamber 16 is induced into the inlet chamber 71 through the noise absorber 11. The oil is intermittently delivered every time each oil reservoir is opened to the outlet chamber 72 accompanied by the pressurizing of the oil. The pressurized oil is introduced into the space 20*a* inside the noise damper 20. Owing to the capacity of the space 20*a* being larger than that of the outlet chamber 72, no or little pulsation occurs in the flow of oil, thereby minimizing the vibration of the pump shaft 4. Thus no harsh noise occurs in the delivery of the working oil.

Figure 9:
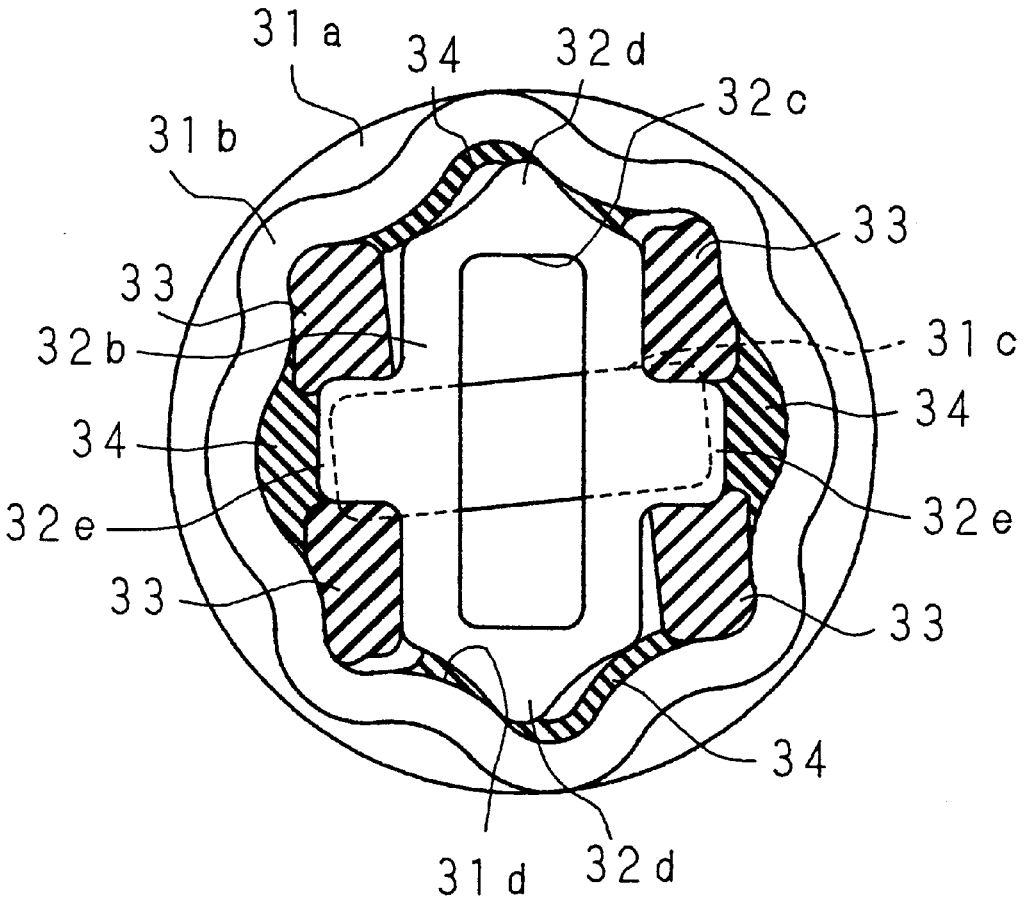
FIG. 9 is a horizontal cross-section showing the state shown in FIG. 8 when a large torque is transmitted.

Referring to FIG. 9, when a large load is applied to the pump 5 so as to generate a large torque, the relative rotation of the sleeve 31 and the sleeve counterpart 32 distorts the elastic spacers 33 and buffers 34 until their elastic deformation becomes extreme, and causes them to turn into a thin film-like layer so as to enable the top and bottom splines 32*d* of the sleeve counterpart 32 to come into linear or dynamically direct contact with the inside wall of the recesses 31*d* of the sleeve 31, thereby transmitting the torque from one to the other straightforwardly. Hereinafter, this state of linear or dynamically direct contact will be referred to as "the direct contact".

After this state is reached, even a large torque can be transmitted from the motor shaft 1 to the pump shaft 4 through the direct contact between the top and bottom splines 32*d* of the sleeve counterpart 32 and the inside surface of the recess 31*d*, thereby steadily transmitting a large torque. The sleeve 31 and the sleeve counterpart 32 are normally made of metal, preferably by cold-working. Metals of high mechanical strength are preferable for transmitting a large torque by the direct contact of the splined projection 32*b* with the undulated inside wall of the recess 31*d*.

Figure 10:
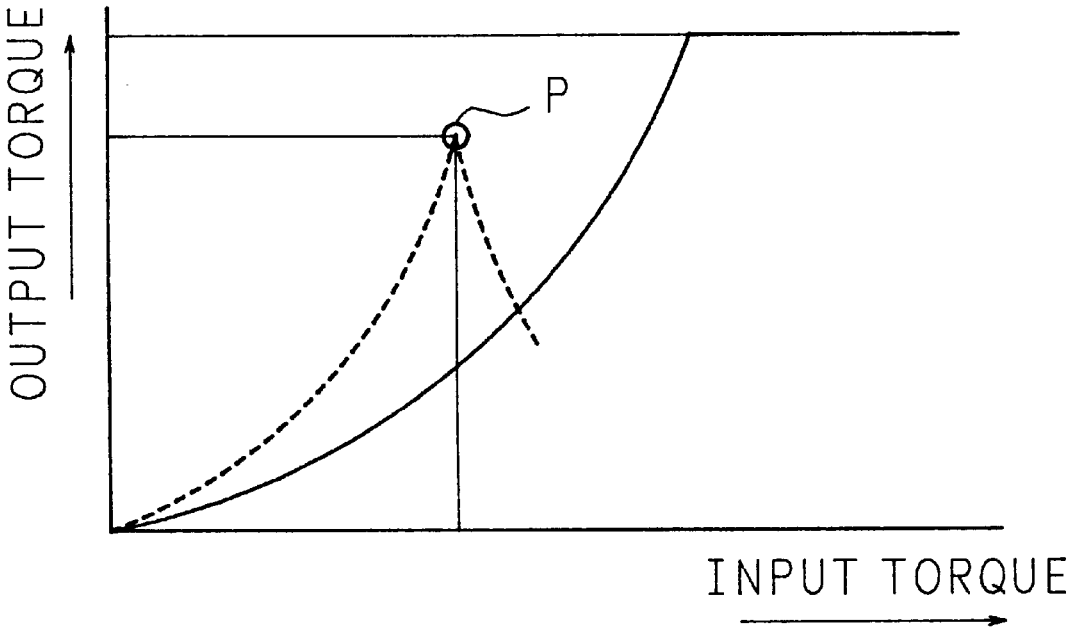
FIG. 10 is a graph showing comparison in the torque transmitting characteristics between the driving coupler of the present invention and the known driving coupler.
Figure 13:
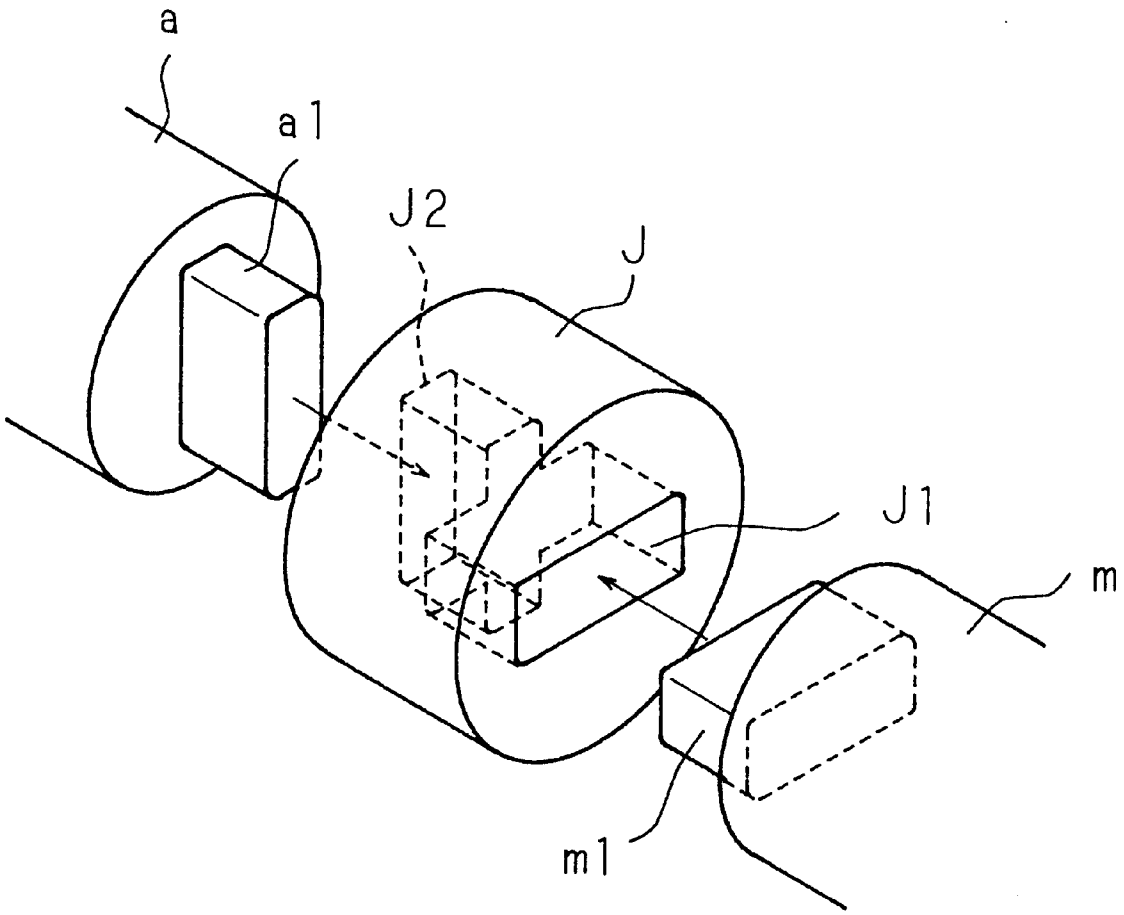
FIG. 13 PRIOR ART
FIG. 13 is a perspective schematic view of a known driving coupler using a conventional mortise and tenon connection.

FIG. 10 is a graph showing the comparison in the torque transmission characteristics between the coupler 3 of the present invention and the known coupler 2 shown in FIG. 13. The known coupler 2 breaks at Point (P) as a result of an increase in the transmitting load in accordance with an increase in the input torque as indicated by the dotted line, thereby stopping transmitting a torque thereafter. The graph shows by the solid line that the coupler 3 of the invention is not affected by the transmitting load at Point (P), thereby steadily continuing to transmit a torque. It will be understood from FIG. 10 that the coupler 3 of the present invention transmits a wide range of torques, large or small, to the pump shaft (output shaft).

Figure 11:
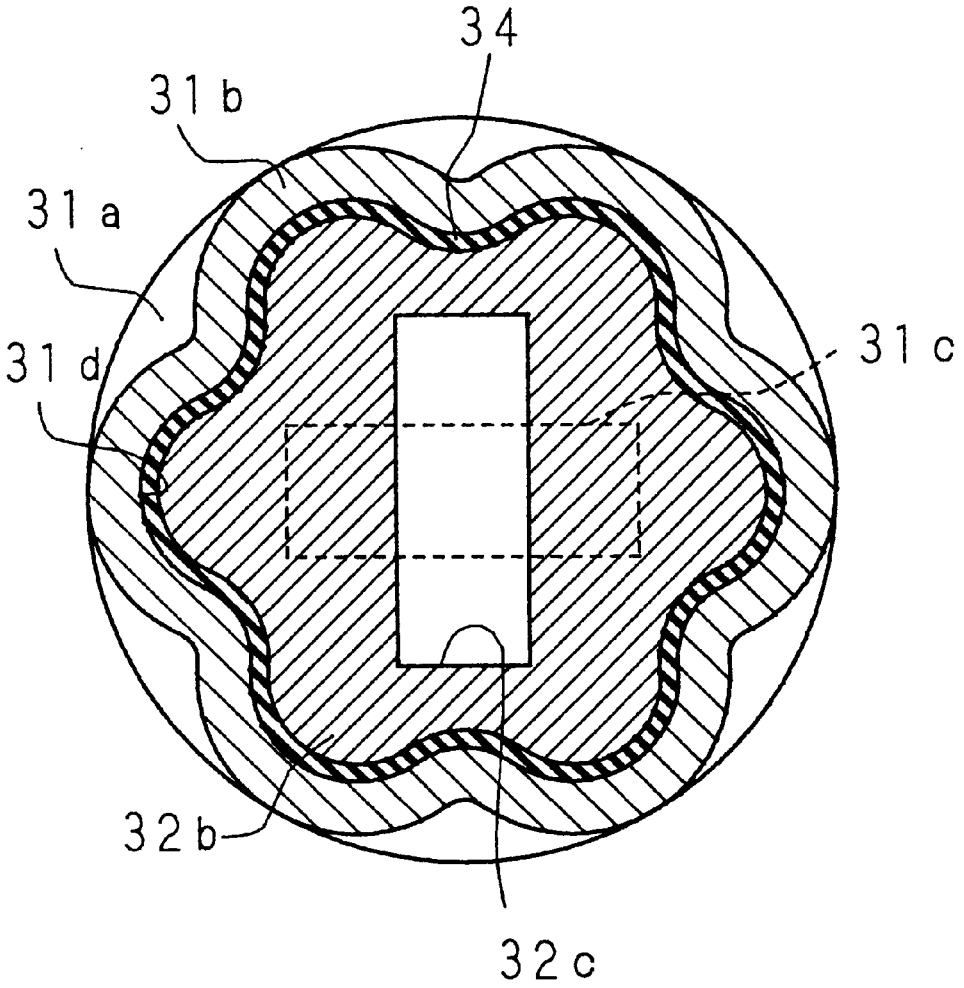
FIG. 11 is a horizontal cross-section showing a second embodiment of the present invention.
Figure 12:
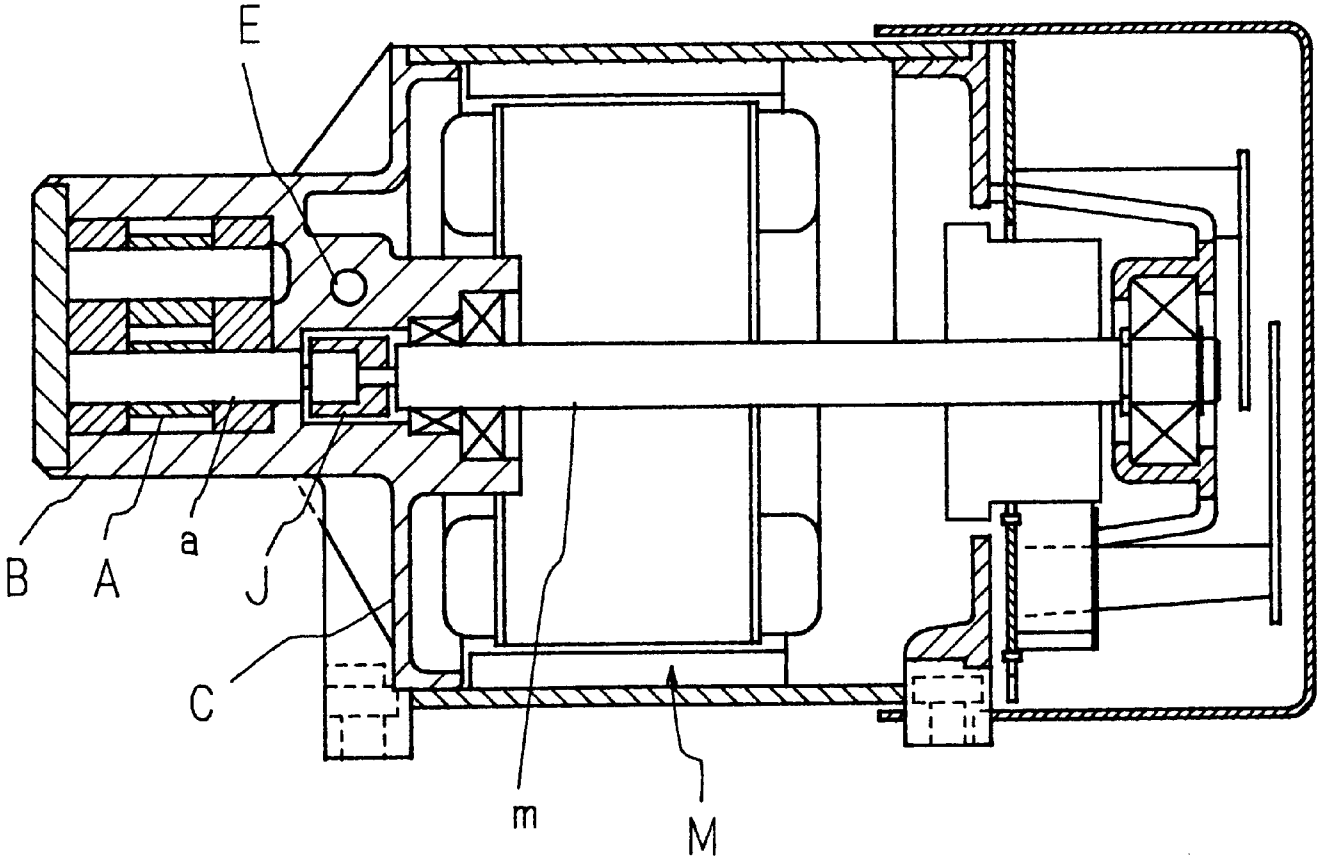
FIG. 12 PRIOR ART
FIG. 12 is a partially cross-sectional side view showing a known motor-driven pump.

Referring to FIG. 11, a modified version of the embodiment will be described:

Like the first embodiment shown in FIG. 8, this coupler also includes a sleeve 31 and a sleeve counterpart 32. FIG. 11 shows the sleeve 31 and sleeve counterpart 32 coupled together. The sleeve 31 has a recess 31*d* of the same configuration as that in the first embodiment, but the sleeve counterpart 32 has similar but smaller splines 32*d* and 32*e* in relation to the recess 31*d* so that an narrow gap having the same width is produced when the splined projection 32*b* is inserted into the recess 31*d* of the sleeve 31. The gap is filled with an elastic material such as rubber to form a buffer layer 34.

The recess 31*d* of the sleeve 31 and the splined projection 32*b* of the sleeve counterpart 32 can be shaped in other form than described above, only if they can mate with each other such that any frictional touch therebetween is maintained during their relative rotation. The elastic material is not limited to rubber, natural or synthetic, but any other elastic material can be used. In the embodiments described above the sleeve 31 is provided for connection to the motor shaft 1 (input shaft), and the sleeve counterpart 32 is provided for connection to the pump shaft 4 (output shaft) but the sleeve 31 and the sleeve counterpart 32 can be interchanged.

It has been described that the coupler is applicable to a pump for delivering hydraulic pressure to a steer-assisting hydraulic cylinder, but it is of course applicable where an accommodation space is limited or where the transmission of a large torque is wanted with no harsh noise.

The motor-driven pump in the first embodiment of the present invention allows the working oil to flow into the outlet chamber 72 through the noise damper 20, thereby ensuring that the working oil is subjected to no or little pulsation. No or little pulsation reduces the possibility of vibration of the pump shaft 4. The noise damper 20 is firmly fixed to the second support 9 by thread-to-thread connection, so that it is protected from fracture and leakage under oil pressure.

Another advantage of the invention is in the provision of the inwardly convex bottom of the noise damper 20, thereby protecting the damper 20 from fracture under a possible build-up of hydraulic pressure on the bottom.

A further advantage of the invention is in the double-walled noise damper, that is, the second support 9 and the cylindrical tank housing 10. This structure eliminates the necessity of using ribs or any other reinforcement. In addition, it is conducive to structural simplicity. A simple structure facilitates air-escape from the noise damper 20. Non-presence of air is essential for preventing cavitation in the flowing oil. The simple noise damper can be manufactured at low cost, thereby reducing the total cost of the motor-driven pump.

A further advantage of the invention is derived from the structure of the sleeve having the recess and the sleeve counterpart having the splined projection engaged with the recess of the sleeve, wherein the spaces between the recess and the splined projection are filled with elastic material such as rubber. The elastic material absorbs vibration occurring during transmission of a torque from the input shaft to the output shaft. When a large torque is transmitted, the elastic material is distorted sufficiently to place the splines of the splined projection into the direct contact with the inside surface of the recess, thereby facilitating the transmission of the large torque without no or little harsh noise.

In the driving coupler according to the present invention no difficulty is involved in filling the spaces between the recesses of the sleeve and the splines of the sleeve counterpart with rubber or any other elastic material, and the sleeve and the sleeve counterpart can be made of metal by cold-working at a reduced cost.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within the metes and bounds of the claims, or equivalents of such metes and bounds thereof are therefore intended to be embraced by the claims.

We claim:

1. A motor-driven hydraulic pump for use in motor vehicles, the pump comprising:

a driving gear connected to a power source;

a follower gear in mesh with the driving gear;

an intake chamber formed on one side of the driving gear and the follower gear mutually in mesh;

an outlet chamber formed on the other side of the intake chamber;

a housing for enclosing the intake chamber and the outlet chamber, the housing being supported by a first support on one side and a second support on the other side and a cylindrical noise damper communicating with the outlet chamber and being fixed to the second support of the housing, the noise damper having a space inside whose capacity is larger than that of the outlet chamber and an inwardly convex bottom.

2. The motor-driven hydraulic pump according to claim 1, wherein the noise damper is fixed to the second support of the housing.

* * * * *